US006289608B1

(12) United States Patent
Kita et al.

(10) Patent No.: US 6,289,608 B1
(45) Date of Patent: Sep. 18, 2001

(54) ATHLETIC SHOE MIDSOLE DESIGN AND CONSTRUCTION

(75) Inventors: Kenjiro Kita; Takaya Kimura, both of Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/571,258

(22) Filed: May 15, 2000

(30) Foreign Application Priority Data

Jul. 2, 1999 (JP) ..... 11-189235

(51) Int. Cl.[7] ..... A43B 13/18
(52) U.S. Cl. ..... 36/28; 36/30 R; 36/37
(58) Field of Search ..... 36/27, 28, 30 R, 36/35 R, 37, 38

(56) References Cited

U.S. PATENT DOCUMENTS

| | | | | |
|---|---|---|---|---|
| 3,170,178 | | 2/1965 | Scholl . | |
| 4,561,195 | | 12/1985 | Onoda et al. . | |
| 4,598,487 | * | 7/1986 | Misevich | 36/28 |
| 4,798,010 | | 1/1989 | Sugiyama . | |
| 4,864,737 | * | 9/1989 | Marrello | 36/28 |
| 5,185,943 | * | 2/1993 | Tong et al. | 36/27 |
| 5,218,773 | * | 6/1993 | Beekman | 36/30 R |
| 5,224,280 | | 7/1993 | Preman et al. . | |
| 5,528,842 | * | 6/1996 | Ricci et al. | 36/27 |
| 5,720,118 | | 2/1998 | Mayer et al. . | |

FOREIGN PATENT DOCUMENTS

| | | |
|---|---|---|
| 0857434 | 8/1998 | (EP) . |
| 0878142 | 11/1998 | (EP) . |
| 0963711 | 12/1999 | (EP) . |
| 0966895 | 12/1999 | (EP) . |
| 61-6804 | 3/1986 | (JP) . |

* cited by examiner

*Primary Examiner*—M. D. Patterson
(74) *Attorney, Agent, or Firm*—W. F. Fasse; W. G. Fasse

(57) ABSTRACT

A midsole assembly for an athletic shoe comprises an upper midsole 3*a* and a lower midsole 3*b* formed of soft elastic material, and a corrugated sheet 4 having a heel portion 4*a* formed with a corrugation. The corrugated sheet 4 is interposed between the upper and lower midsoles 3*a*, 3*b*. Upwardly and downwardly extending walls 6, 7 and 8 are formed at the medial and lateral sides of the corrugated sheet 4. Thereby, transverse or lateral deformation of the heel portion of the midsole 3 can be securely prevented and running stability can be further improved.

21 Claims, 5 Drawing Sheets

ATHLETIC SHOE MIDSOLE DESIGN AND CONSTRUCTION

CROSS-REFERENCE TO RELATED APPLICATION

This application is related to copending U.S. patent application Ser. No. 09/318,578, of the same assignee as the present application.

BACKGROUND OF THE INVENTION

The present invention relates to a midsole assembly for an athletic shoe and, more particularly, to the improvement of a midsole construction, which is comprised of a midsole and a corrugated sheet inserted into the midsole.

The sole of an athletic shoe for use in various sports is generally comprised of a midsole and an outsole. The midsole is typically formed of soft elastic material in order to ensure adequate cushioning properties. The outsole is fitted under the midsole and directly contacts with the ground.

Running stability as well as adequate cushioning properties are required in athletic shoes. There is a need to prevent shoes from being deflected or deformed excessively in the lateral or transverse direction when athletes strike or impact onto the ground with the shoes.

As shown in Japanese Utility Model publication No. 61-6804, the applicant of the present invention proposes a midsole assembly having a corrugated sheet therein.

Such a midsole construction including a corrugated sheet at the heel portion of a midsole produces resistant force, which prevents the heel portion of a midsole from being deformed laterally or transversely when an athlete strikes or impacts onto the ground. Thereby, the excessive transverse or lateral deformation of the heel portion of a shoe is prevented and running stability is secured.

On the other hand, in athletics such as tennis or basketball where rapid lateral movement is included, there has been a strong request that lateral deflection of shoes during games be more securely prevented and running stability be further improved.

An object of the present invention is to provide a midsole assembly for an athletic shoe that can more securely prevent lateral deflection or deformation after athletes strike or impact onto the ground with the shoes. Another object of the present invention is to provide a midsole assembly for an athletic shoe that cannot only prevent lateral deflection securely but also improve cushioning properties.

SUMMARY OF THE INVENTION

The present invention provides a midsole assembly for an athletic shoe for use in various sports, such as running, track, basketball, football, baseball, soccer, tennis, golf, biking, and the like.

In one embodiment, a midsole assembly is comprised of upper and lower midsoles formed of soft elastic material, and a corrugated sheet disposed at least at the heel portion between the upper and lower midsoles. The corrugated sheet has an upwardly and/or downwardly extending wall placed at medial and lateral sides of the heel portion.

In another embodiment, the upwardly extending wall is formed at a convex face side and/or a concave face side of corrugation of the corrugated sheet.

In yet another embodiment, the downwardly extending wall is formed at a convex face side and/or a concave face side of corrugation of the corrugated sheet.

A further embodiment provides a midsole assembly where an aperture is formed at the contact area between the upper or lower midsole and the corrugated sheet.

In a still further embodiment, the aperture is formed at a convex or concave face of corrugation of the corrugated sheet.

In an additional embodiment, the aperture is a through hole penetrating through the upper or lower midsole.

In a preferred embodiment, because the corrugated sheet is interposed between the upper and lower midsoles at least at the heel portion, lateral deflection or deformation of the heel portion of the midsoles can be prevented. Moreover, in this case, when the corrugated sheet has upwardly extending walls at its medial and lateral sides, the medial and lateral sides of the upper midsole are sandwiched between the oppositely disposed walls. When the corrugated sheet has downwardly extending walls at its medial and lateral sides, the medial and lateral sides of the lower midsole are sandwiched between the oppositely disposed walls.

Thus, when the heel portion of the upper and lower midsoles is going to deflect in the lateral direction after an athlete's striking the ground, the upwardly and/or downwardly extending walls prevent the heel portion of the upper and lower midsoles from being deformed in the lateral direction, which further improves the running stability.

In a further embodiment, because the upper or lower midsole has an aperture at the contact region with the corrugated sheet, the corrugated sheet is easy to be deformed relative to the vertical load at a region where an aperture is formed. Thereby, cushioning properties are advanced. In addition, when an aperture is a through hole, cushioning properties can be improved across the whole width of the midsole.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
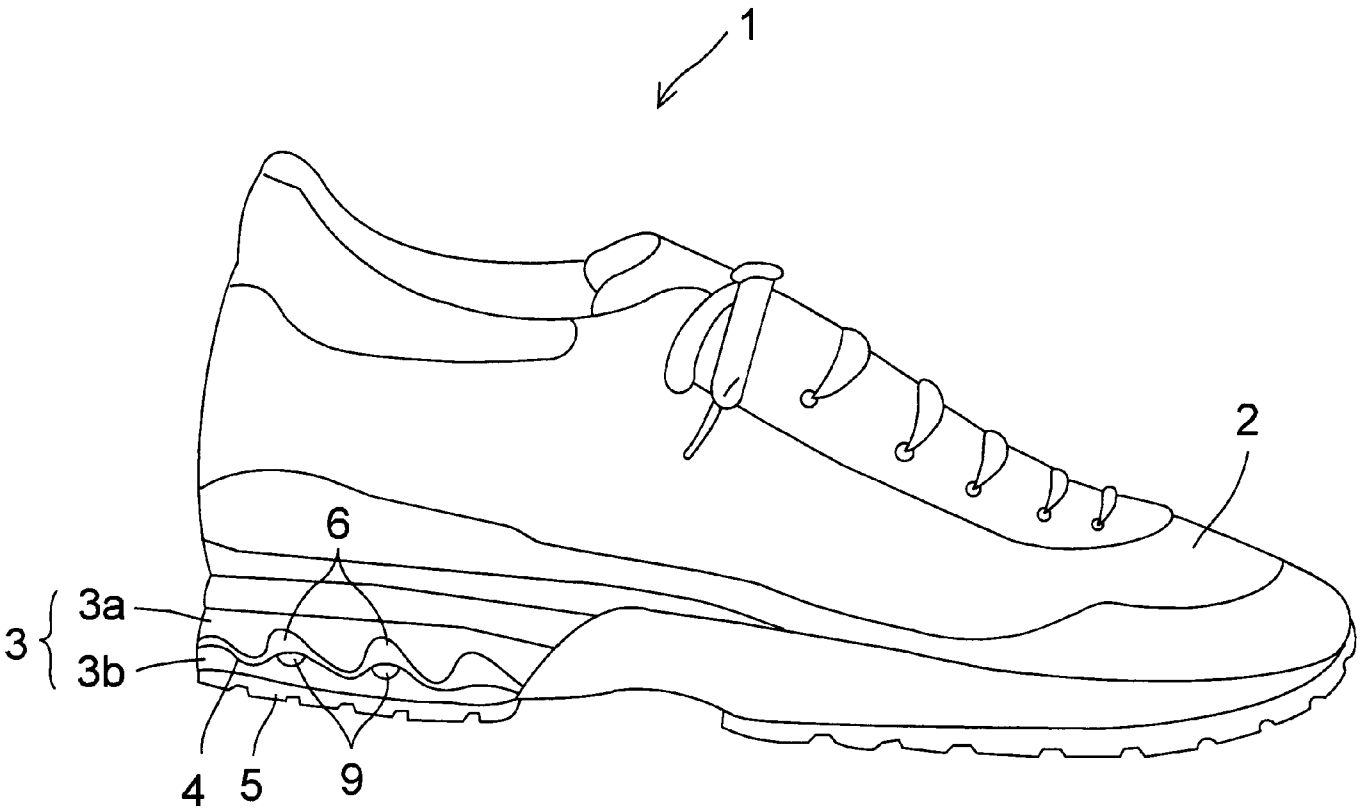
FIG. 1 is a side view of an athletic shoe employing the midsole construction of the present invention.

Turning now to the drawings, FIG. 1 illustrates an athletic shoe incorporating a midsole construction of the present invention. The sole of this athletic shoe 1 comprises a midsole 3 attached under an upper 2, a corrugated sheet 4 disposed in the midsole 3 and an outsole 5 attached under the midsole 3 and directly contacting with the ground.

The midsole 3 is provided in order to absorb shock load imparted on the heel portion of the shoe 1 when an athlete strikes onto the ground. The midsole 3 is comprised of an upper midsole 3*a* and a lower midsole 3*b* that are respectively disposed on the top and bottom surfaces of the corrugated sheet 4.

The midsole 3 is generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber is used.

The corrugated sheet 4 is formed of thermoplastic resin such as thermoplastic polyurethane (TPU) of comparatively rich elasticity, polyamide elastomer (PAE), ABS resin or the like. Alternatively, the corrugated sheet 4 may be formed of thermosetting resin such as epoxy resin, unsaturated polyester resin or the like.

Figure 2:
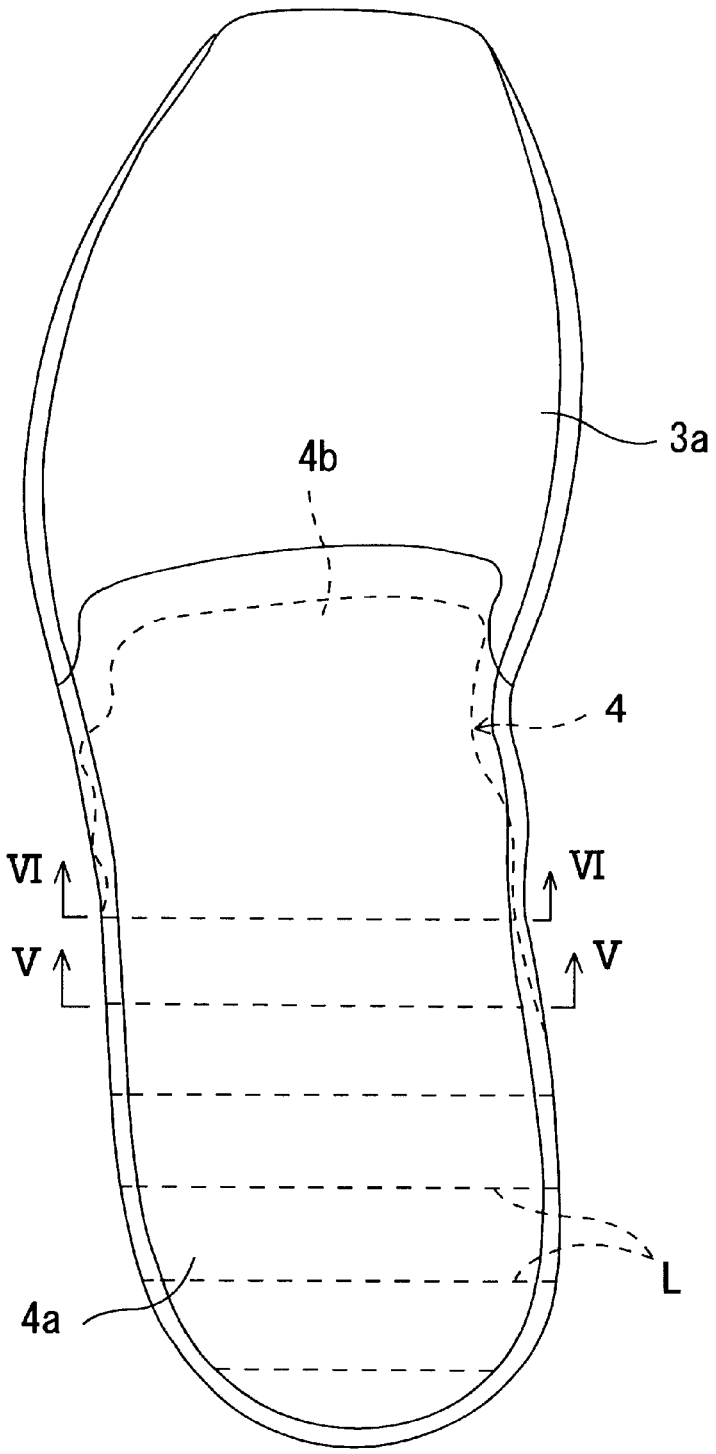
FIG. 2 is a top plan view of the midsole construction of a left side shoe according to the present invention.

As shown in FIG. 2, the corrugated sheet 4 extends from the heel region to the midfoot region of the midsole 3. The corrugated sheet 4 is comprised of a heel portion 4*a* having corrugations and a generally planar midfoot portion 4*b* integrally formed with the heel portion 4*a*. In FIG. 2, a broken line extending in the width direction at the heel portion 4*a* indicates a crest or trough line of corrugations of the corrugated sheet 4.

Figure 3A:
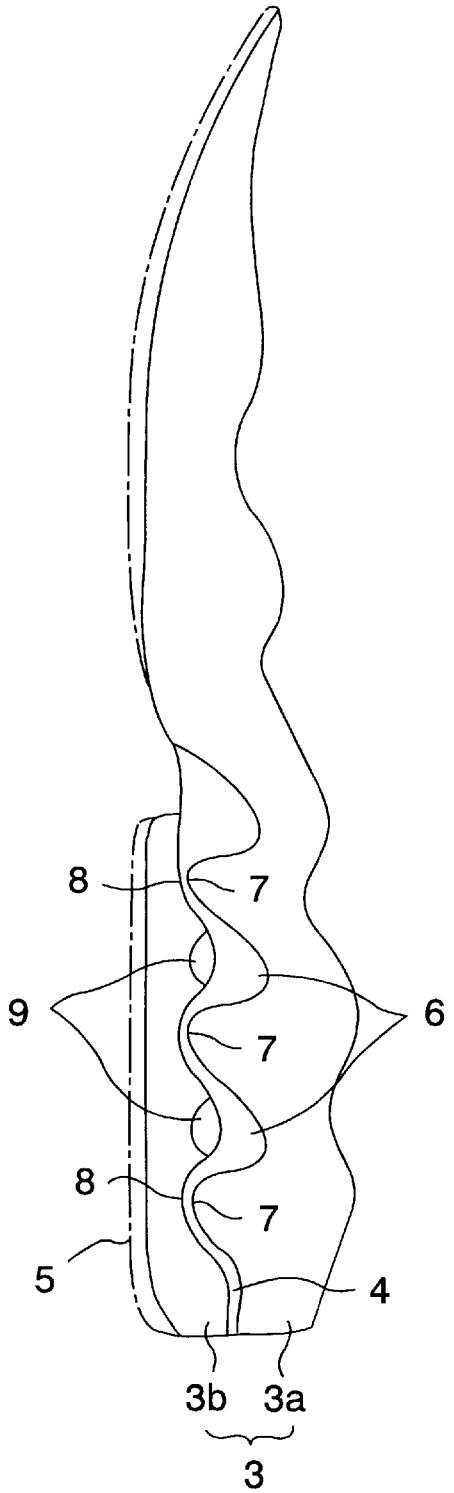
FIG. 3A is a lateral side view of the midsole construction of FIG. 2.
Figure 3B:
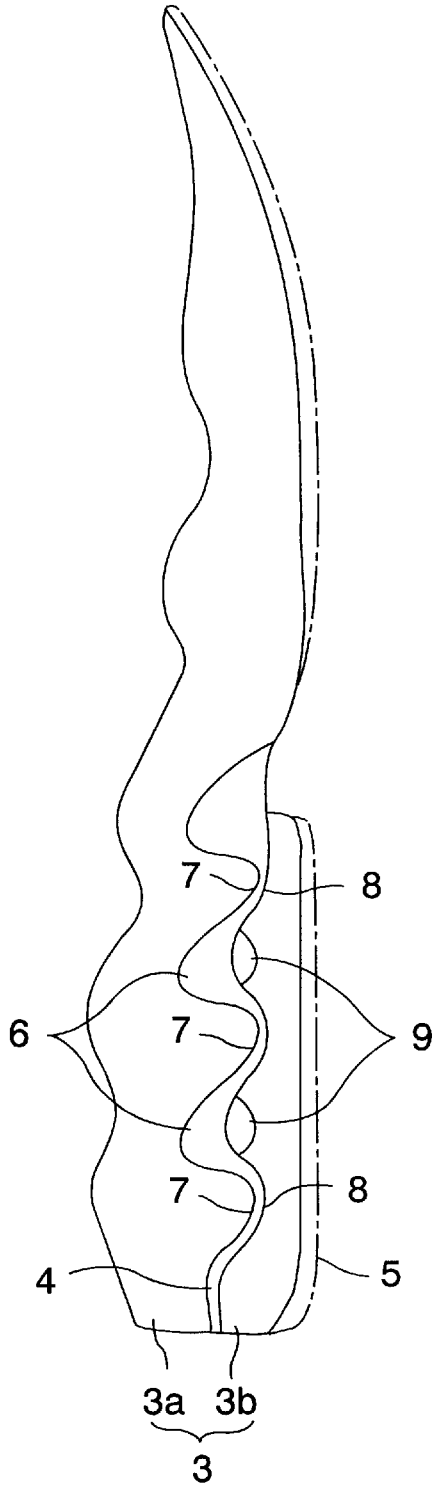
FIG. 3B is a medial side view of the midsole construction of FIG. 2
Figure 4:
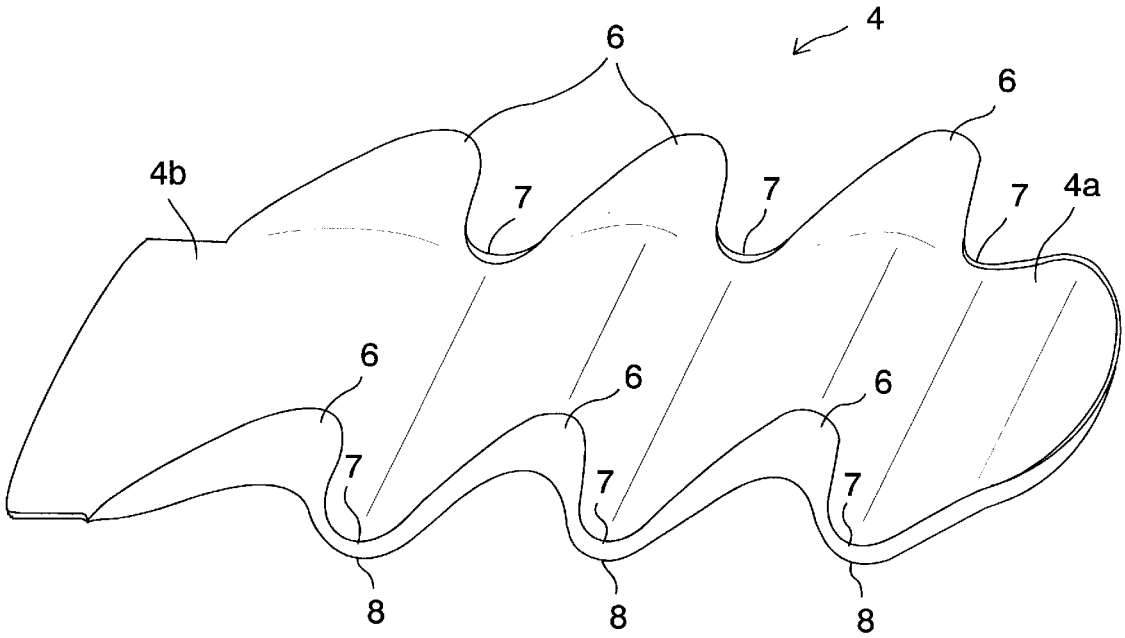
FIG. 4 is a perspective view of a corrugated sheet.

As shown in FIGS. 3A, 3B, a plurality of upwardly extending walls 6 are formed at the inner or medial and outer or lateral sides of the corrugated sheet 4 (see FIG. 4). These walls 6 are in the form of curved side wall lobes with respective protruding curved contours that are discontinuously provided at the crest or convex sides of the corrugations of the corrugated sheet 4, without continuously and uniformly extending along plural adjacent corrugations. The inner and outer side faces of the upper midsole 3*a* are sandwiched between the oppositely disposed walls 6, shown in FIG. 5.

Figure 6:
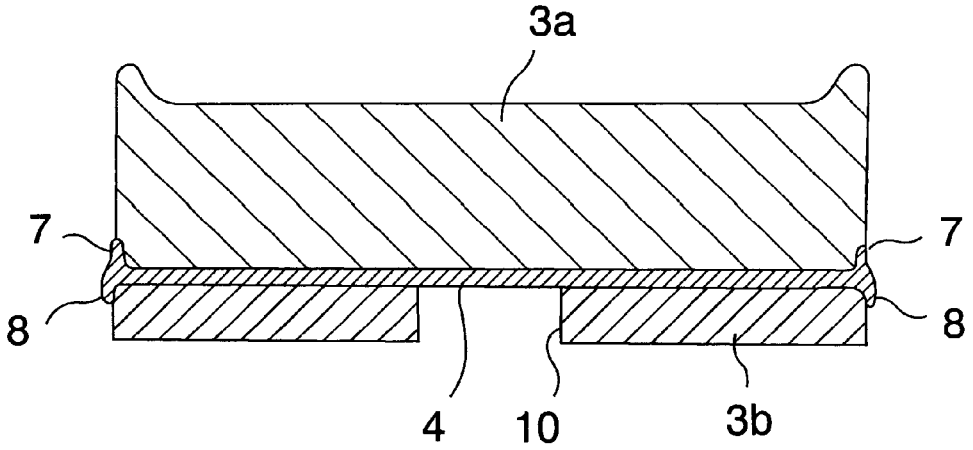
FIG. 6 a cross sectional view of the midsole construction of FIG. 2 taken along line VI—VI.

At the trough or concave side of corrugations of the corrugated sheet 4, there is formed a plurality of slightly upwardly extending walls 7 (see FIGS. 3A, 3B and 4). As shown in FIG. 6, the inner and outer side faces of the upper midsole 3*a* are also sandwiched between the oppositely disposed walls 7.

At the other convex side of corrugations of the corrugated sheet 4, there are formed a plurality of slightly downwardly extending walls 8 (see FIGS. 3A, 3B and 4). As shown in FIG. 6, the inner and outer side faces of the lower midsole 3*b* are sandwiched between the oppositely disposed walls 8.

Figure 5:
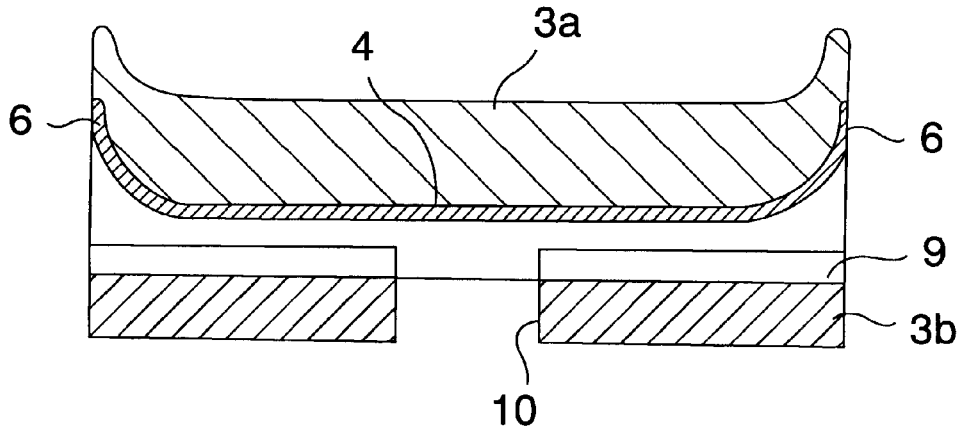
FIG. 5 is cross sectional view of the midsole construction of FIG. 2 taken along line V—V.

Moreover, a plurality of apertures 9 are formed at the contact area of the lower midsole 3*b* with the corrugated sheet 4. These apertures 9 are provided at the concave side of corrugation of the corrugated sheet 4. As shown in FIG. 5, the apertures 9 are through holes penetrating the lower midsole 3*b* in the width direction. In addition, the lower midsole 3*b* is formed with a vertically extending through hole 10 for improvement of its cushioning properties, shown in FIGS. 5 and 6.

In this case, the heel portion 4*a* of the corrugated sheet 4 placed at the heel region prevents the heel region of the midsole 3 from being deflected and deformed in the lateral or transverse direction after an athlete's striking the ground.

Furthermore, the deflecting movement of the heel region of the upper midsole 3*a* is also prevented by the upwardly extending walls 6, 7, and the deflecting movement of the heel region of the lower midsole 3*b* is also prevented by the downwardly extending wall 8. Thereby, transverse deformation of the heel region is more securely prevented and running stability is further improved.

Moreover, in this case, deformation of the corrugated sheet 4 relative to the vertical load is easier at the regions where the apertures 9 are formed. Thereby, cushioning properties are advanced. Additionally, because the apertures 9 are through holes, cushioning properties across the whole width of the midsole 3 are improved and the midsole 3 is lighter in weight.

In another embodiment, the upwardly extending wall of the corrugated sheet 4 is formed either at the convex side or at the concave side of corrugation of the corrugated sheet 4.

In yet another embodiment, the downwardly extending wall of the corrugated sheet 4 is formed at the concave side of corrugation of the corrugated sheet 4. Alternatively, the downwardly extending wall may be formed at both the convex side and the concave side.

In a further embodiment, the apertures 9 are formed at the upper midsole 3*a*. In the alternative, the apertures 9 may be formed at the convex side of corrugation of the corrugated sheet 4.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A midsole assembly for an athletic shoe comprising:

a midsole formed of a soft elastic material and including a midsole heel portion that comprises an upper midsole portion and a lower midsole portion below said upper midsole portion; and a corrugated sheet including a corrugated sheet body disposed between at least said upper midsole portion and said lower midsole portion of said midsole heel portion;

wherein said corrugated sheet body has a corrugated wave configuration including a plurality of linearly extending wave crests and wave troughs;

wherein said wave crests each respectively have a wave crest convex surface facing upwardly toward said upper midsole portion and a wave crest concave surface facing downwardly toward said lower midsole portion, and said wave troughs each respectively have a wave trough concave surface facing upwardly toward said upper midsole portion and a wave trough convex surface facing downwardly toward said lower midsole portion;

wherein said corrugated sheet further includes respective first side walls protruding from said corrugated sheet body at a medial side and a lateral side of said midsole heel portion; and wherein said first side walls respectively protrude upwardly from said wave crest convex surfaces of said wave crests or downwardly from said wave trough convex surfaces of said wave troughs at said medial side and said lateral side of said midsole heel portion, without continuously and uniformly extending along plural adjacent ones of said wave crests and said wave troughs.

2. The midsole assembly according to claim 1, wherein said first side walls respectively protrude upwardly from said wave crest convex surfaces of said wave crests.

3. The midsole assembly according to claim 1, wherein said first side walls respectively protrude downwardly from said wave trough convex surfaces of said wave troughs.

4. The midsole assembly according to claim 1, wherein said wave crests and said wave troughs respectively extend linearly along crest lines and trough lines that extend transversely across a width of said midsole.

5. The midsole assembly according to claim 1, wherein said first side walls comprise first side wall lobes that each respectively protrude individually upwardly from said wave crest convex surfaces or downwardly from said wave trough convex surfaces.

6. The midsole assembly according to claim 5, wherein said first side wall lobes are discontinuous from each other, protrude from said wave crest convex surfaces, do not protrude from said wave trough convex surfaces, and do not protrude from any of said concave surfaces.

7. The midsole assembly according to claim 5, wherein said first side wall lobes are discontinuous from each other, protrude from said wave trough convex surfaces, do not protrude from said wave crest convex surfaces, and do not protrude from any of said concave surfaces.

8. The midsole assembly according to claim 5, wherein said first side wall lobes are respective first curved side wall lobes that each respectively protrude with a curved contour upwardly from said wave crest convex surfaces or downwardly from said wave trough convex surfaces.

9. The midsole assembly according to claim 5, wherein said first side wall lobes respectively protrude individually upwardly from said wave crest convex surfaces, wherein said corrugated sheet further includes second side wall portions that respectively protrude upwardly from said wave trough concave surfaces between respective successive ones of said first side wall lobes at said medial side and said lateral side, wherein said first side wall lobes respectively have a first upward protrusion height relative to said wave crest convex surfaces, and wherein said second side wall portions respectively have a second upward protrusion height relative to said wave trough concave surfaces that is smaller than said first upward protrusion height.

10. The midsole assembly according to claim 9, wherein said corrugated sheet further includes third side wall portions that respectively protrude downwardly from said wave trough convex surfaces opposite said second side wall portions at said medial side and said lateral side, and wherein said third side wall portions respectively have a third downward protrusion height relative to said wave trough convex surfaces that is smaller than said first upward protrusion height.

11. The midsole assembly according to claim 5, wherein said first side wall lobes respectively protrude individually upwardly from said wave crest convex surfaces, wherein said corrugated sheet further includes third side wall portions that respectively protrude downwardly from said wave trough convex surfaces at said medial side and said lateral side, wherein said first side wall lobes respectively have a first upward protrusion height relative to said wave crest convex surfaces, and wherein said third side wall portions respectively have a third downward protrusion height relative to said wave trough convex surfaces that is smaller than said first upward protrusion height.

12. The midsole assembly according to claim 5, wherein said first side wall lobes respectively protrude individually downwardly from said wave trough convex surfaces, wherein said corrugated sheet further includes second side wall portions that respectively protrude downwardly from said wave crest concave surfaces between respective successive ones of said first side wall lobes at said medial side and said lateral side, wherein said first side wall lobes respectively have a first downward protrusion height relative to said wave trough convex surfaces, and wherein said second side wall portions respectively have a second downward protrusion height relative to said wave crest concave surfaces that is smaller than said first downward protrusion height.

13. The midsole assembly according to claim 12, wherein said corrugated sheet further includes third side wall portions that respectively protrude upwardly from said wave crest convex surfaces opposite said second side wall portions at said medial side and said lateral side, and wherein said third side wall portions respectively have a third upward protrusion height relative to said wave crest convex surfaces that is smaller than said first downward protrusion height.

14. The midsole assembly according to claim 5, wherein said first side wall lobes respectively protrude individually downwardly from said wave trough convex surfaces, wherein said corrugated sheet further includes third side wall portions that respectively protrude upwardly from said wave crest convex surfaces at said medial side and said lateral side, wherein said first side wall lobes respectively have a first downward protrusion height relative to said wave trough convex surfaces, and wherein said third side wall portions respectively have a third upward protrusion height relative to said wave crest convex surfaces that is smaller than said first downward protrusion height.

15. The midsole assembly according to claim 1, wherein said corrugated sheet consists of a polymer resin.

16. The midsole assembly according to claim 1, further having a linearly extending aperture between said corrugated sheet body and said soft elastic material of said midsole, wherein said aperture extends linearly parallel to at least one of said wave crests and wave troughs.

17. The midsole assembly according to claim 16, wherein said aperture extends linearly along one of said convex surfaces.

18. The midsole assembly according to claim 16, wherein said aperture extends linearly along one of said concave surfaces.

19. The midsole assembly according to claim 16, wherein said wave crests and said wave troughs extend respectively along crest lines and trough lines that extend transversely across a width of said midsole, and wherein said aperture extends linearly in a direction parallel to at least one of said crest lines and trough lines.

20. The midsole assembly according to claim 16, wherein said aperture is a through hole that penetrates entirely through said midsole from said lateral side to said medial side between said corrugated sheet body and said soft elastic material.

21. The midsole assembly according to claim 20, further having a vertical hole penetrating vertically through said lower midsole portion to said corrugated sheet body.

* * * * *